US008337016B2

(12) United States Patent
Liebers et al.

(10) Patent No.: US 8,337,016 B2
(45) Date of Patent: Dec. 25, 2012

(54) HANGER SYSTEM FOR GLASSES AND CASE

(75) Inventors: Steven B. Liebers, Norristown, PA (US); Zhongqiu Zhu, Wenzhou (CN)

(73) Assignee: Diversified Products, Inc., Collegeville, PA (US)

( * ) Notice: Subject to any disclaimer, the term of this patent is extended or adjusted under 35 U.S.C. 154(b) by 159 days.

(21) Appl. No.: 12/941,456

(22) Filed: Nov. 8, 2010

(65) Prior Publication Data

US 2012/0113383 A1 May 10, 2012

(51) Int. Cl.
*G02C 1/00* (2006.01)

(52) U.S. Cl. ..... 351/158; 248/902

(58) Field of Classification Search ..... 351/41, 351/51, 52, 63, 158; 24/3.1, 3.7, 3.8; 206/5, 206/6; 211/85.1, 104; 248/309.1, 902
See application file for complete search history.

(56) References Cited

U.S. PATENT DOCUMENTS

| | | | |
|---|---|---|---|
| 646,638 | A | 4/1900 | Cutler |
| 1,333,765 | A | 3/1920 | Moore |
| 2,656,917 | A | 10/1953 | Hollis |
| 3,136,409 | A | 6/1964 | Schumann |
| 3,329,386 | A | 7/1967 | Rosen |
| 3,370,733 | A | 2/1968 | Giesler |
| 3,819,033 | A | 6/1974 | Hueber |
| 3,884,443 | A | 5/1975 | McMaster |
| 3,885,667 | A | 5/1975 | Spiegel et al. |
| 4,132,309 | A | 1/1979 | Shaylor |
| 4,257,522 | A | 3/1981 | Thorneburg |
| D261,481 | S | 10/1981 | Haubert |
| D264,185 | S | 5/1982 | Roberts |
| D289,016 | S | 3/1987 | Campbell |
| D308,080 | S | 5/1990 | Sachs |
| 5,000,410 | A | 3/1991 | Beavers |
| 5,002,187 | A | 3/1991 | Rysner et al. |
| 5,044,773 | A | 9/1991 | Harms et al. |
| 5,046,696 | A | 9/1991 | Lee |
| 5,129,617 | A | 7/1992 | MacWilliamson |
| 5,144,345 | A | 9/1992 | Nyman |
| 5,340,074 | A | 8/1994 | Porcaro et al. |
| D357,278 | S | 4/1995 | Turney |
| 5,423,505 | A | 6/1995 | David |
| 5,477,964 | A | 12/1995 | Hart |
| 5,484,056 | A | 1/1996 | Wood |
| 5,559,567 | A | 9/1996 | Kolton et al. |
| 5,636,821 | A | 6/1997 | Davies |
| D381,046 | S | 7/1997 | Hiers et al. |
| 5,672,238 | A | 9/1997 | Samuelson |

(Continued)

*Primary Examiner* — Huy K Mai
(74) *Attorney, Agent, or Firm* — Caesar, Rivise, Bernstein, Cohen & Pokotilow, Ltd.

(57) ABSTRACT

A hanger system for glasses includes glasses, a carrier, and a hanger. The glasses include a frame, lenses, hinges, and temple arms. The hanger includes a main body having a top portion for attachment to a hook and a lower portion for securing the carrier. A support is cantilevered from the main body. A first end of the support is integral to the top portion and extends out a distance of at least the depth the glasses, the second end has a hinged tab and has an aperture to receive one of the pair of temple arms. The glasses are supported where front of the frame is oriented toward the main body and the temple arms are oriented away from main body. The hinged tab provides for opening of the temple arms to allow a user to try on the glasses while the glasses remain attached to the hanger.

11 Claims, 5 Drawing Sheets

U.S. PATENT DOCUMENTS

| | | | | |
|---|---|---|---|---|
| 5,699,907 | A | 12/1997 | Langenstuck | |
| 5,699,990 | A | 12/1997 | Seach | |
| 5,743,403 | A | 4/1998 | Crysdale | |
| 5,791,470 | A | 8/1998 | Usui | |
| 5,791,608 | A | 8/1998 | Nielsen et al. | |
| 5,823,503 | A | 10/1998 | Wasserman | |
| RE36,258 | E | 7/1999 | Coward et al. | |
| 6,032,793 | A | 3/2000 | Oakley | |
| D431,460 | S | 10/2000 | Nichol | |
| 6,575,295 | B2 | 6/2003 | Mayfield | |
| 6,581,760 | B1 | 6/2003 | Robertson | |
| D478,510 | S | 8/2003 | Kumakura | |
| 6,637,591 | B2 | 10/2003 | Chen | |
| 6,648,132 | B1 | 11/2003 | Smouha | |
| 6,808,069 | B1 | 10/2004 | O'Toole | |
| D497,800 | S | 11/2004 | Trettin | |
| 6,827,210 | B2 | 12/2004 | Chen | |
| 6,994,307 | B2 | 2/2006 | Curtsinger et al. | |
| 7,055,680 | B2 | 6/2006 | Liebers | |
| D527,634 | S | 9/2006 | Liebers | |
| D545,675 | S | 7/2007 | Liebers | |
| 7,523,909 | B1 | 4/2009 | Liebers et al. | |
| 7,762,511 | B1 | 7/2010 | Liebers et al. | |
| 7,938,535 | B2 * | 5/2011 | Orlinsky et al. | 351/158 |
| 2002/0189955 | A1 | 12/2002 | Waters | |

* cited by examiner

HANGER SYSTEM FOR GLASSES AND CASE

BACKGROUND OF THE INVENTION

This invention relates to a hanger system for glasses and an accompanying case for use on a hanging type display stand.

Various display hangers exist in the prior art for hanging various articles, such as hand tools and the like. For example, U.S. Pat. No. 5,484,056 (Wood) teaches a display hanger for suspending an article such as a screwdriver. A special elastomeric grommet is used to hang the tool.

Additionally, U.S. Pat. No. 3,884,443 (McMaster) teaches a pressure-sensitive hanger for small articles such as merchandise packages, wall packages and the like that can be hung on display rods or hooks. This invention is directed to a universal hanger that is applied with adhesive to a small item. Here, a means to prevent peeling of the hanger from the product to which it is secured is included.

Various eyeglass hangers are also known. For example, U.S. Pat. Nos. 7,523,909 (Liebers et al.) and 7,762,511 (Liebers et al.) disclose a hanger for holding glasses and a case that allows a user to try on the glasses such that the glasses remain attached to the case by the hanger and such that the matched pair of glasses and case always remain together, thereby avoiding loss, mismatched glasses and cases, etc.

U.S. Pat. No. 5,046,696 (Lee) teaches a holder for eyeglasses which accepts a temple portion of an eyeglass frame for supporting eyeglasses in a vertical position. The holder may be mounted, for example, in an automobile, boat or convenient location in a home. The design includes a planar first member and a second member integral to the first which protrudes outwardly. An opening between the first and second members accepts the temple of the eyeglass frame. An adhesive is applied to a surface of the first member for adhesion of the device to another surface.

U.S. Pat. Nos. D545,675 (Liebers), D527,634 (Liebers), and 7,055,680 (Liebers) disclose a hanger for a case holding a pair of glasses. The hanger includes a web of flexible material having an elongate main body portion having an upper end and a lower end and a pair of tabs extending from the lower end of the main body portion. The tabs encircle the case. An aperture adjacent to the upper end of the main body portion receives a support for hanging the hanger, thereby holding the case.

Recently, styles for glasses have shown increasing importance with respect to the decorative aspects of the temple arms. However, no known hanger for glasses discloses a hanger for holding glasses and a case that allows a user to try on the glasses such that the glasses remain attached to the case by the hanger and such that a the matched pair of glasses and case always remain together, thereby avoiding loss, mismatched glasses and cases, and which additionally prominently displays a temple arm for clear viewing by a potential customer.

All references cited herein are incorporated herein by reference in their entireties.

BRIEF SUMMARY OF THE INVENTION

The present invention is directed to a hanger system for glasses and an accompanying case. The hanger system includes glasses having a lens support frame supporting a pair of lenses, a pair of hinges integral to the lens support frame, and a pair of temple arms hinged to the lens support frame with the pair of hinges. The frame of the glasses has a depth that is a length from the front of the frame to the hinges. The system further includes a carrier for the glasses and a hanger.

The hanger includes a main body having a top portion adapted for attachment to a display hook and a lower portion for securing the carrier to the hanger. A support is cantilevered from the main body and has a first end and a second end. The first end is integral to the top portion of the main body and extends out from the main body a distance of at least the depth from the front of the frame to the hinges. The second end of the support has a hinged tab. The hinged tab has an aperture to receive one of the pair of temple arms. The glasses are supported where front of the frame is oriented toward the main body and the pair of temple arms is oriented in a direction away from main body when the temple arms are in a folded condition. The hinged tab provides for opening of the temple arms relative to the frame to allow a user to try on the glasses while the glasses remain attached to the hanger. However, when the hanger system is on display, a temple arm of the glasses is prominently displayed toward the user.

The top portion of the main body of the hanger may be constructed from a thin, flexible web. The lower portion of the main body of the hanger may include a web having a pair of legs extending down from the top portion. The legs are for receiving the carrier. The carrier is preferably a pouch, but may be another type of case or other article that is capable of holding the glasses. Preferably, the pouch is constructed from a flexible material.

The support is preferably generally perpendicular to the main body. The top portion of the main body may include an aperture to receive a the display hook. The hinged tab may be fastened to the temple arm that extends through the aperture with a fastener, where the fastener is preferably a cable tie. The hinged tab may be hinged to the support by a living hinge. Finally, the hanger system may have a security tag attached thereto.

In a more simple form, a hanger system for glasses and case is provided which includes glasses having a lens support frame supporting a pair of lenses, a pair of hinges integral to the lens support frame, and a pair of temple arms hinged to the lens support frame with the pair of hinges. The hanger system further includes a carrier (i.e., a case) for the glasses and a hanger. The hanger includes a main body having a top portion for attachment to a display hook and a lower portion for securing the carrier to the hanger. Finally, the hanger includes a support cantilevered from the main body to support the glasses where front of the frame is oriented toward the main body and the pair of temple arms is oriented in a direction away from main body, when the temple arms are in a folded condition. When a user tries on the glasses, the glasses remain attached to the hanger.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
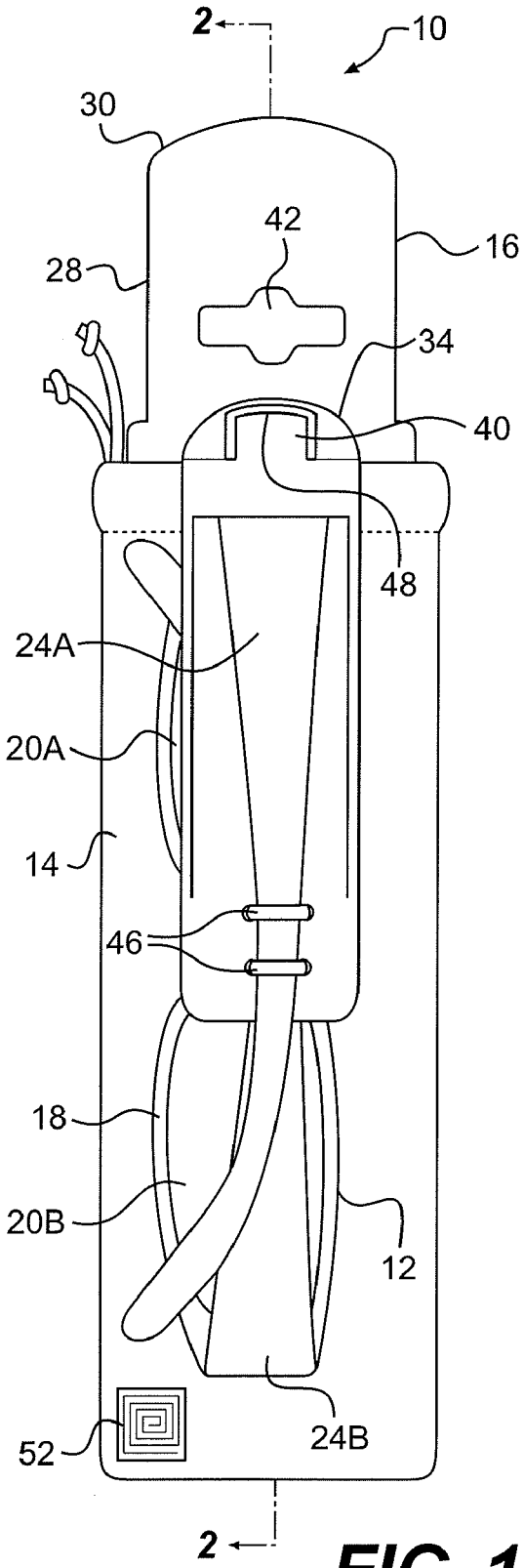
FIG. 1 is a front elevation view of a hanger system for glasses and case in accordance with a preferred embodiment of the present design, shown with glasses and case.
Figure 2:
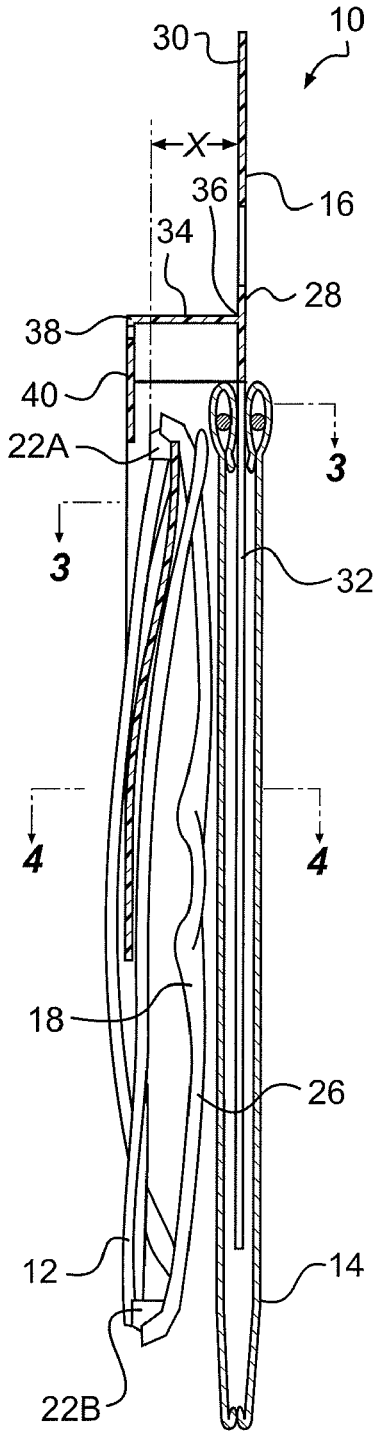
FIG. 2 is a cross-sectional view of the hanger system for glasses and case of FIG. 1, taken along lines 2-2 of FIG. 1.
Figure 3:
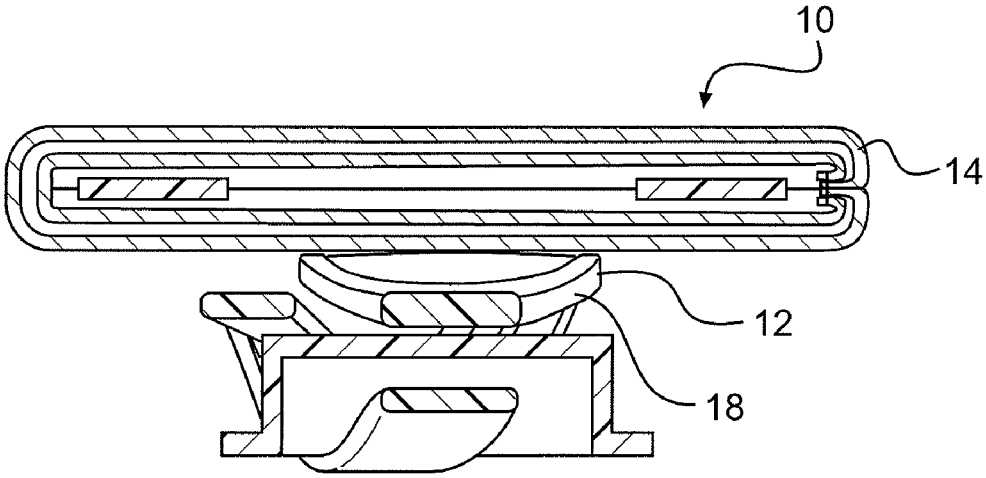
FIG. 3 is a cross-sectional view of the hanger system for glasses and case of FIG. 1, taken along lines 3-3 of FIG. 1.

The invention will be illustrated in more detail with reference to the following embodiment, but it should be understood that the present invention is not deemed to be limited thereto.

Referring now to the drawings, wherein like part numbers refer to like elements throughout the several views, there is shown in FIGS. 1-8, a hanger system for glasses 10 in accordance with a preferred embodiment of the present invention. The hanger system 10 includes glasses 12, a carrier 14 (such as a pouch or case), and a hanger 16.

The hanger 16 is constructed from, for example, a thin web of polyvinylchloride. Paper, cardboard or nearly any other suitable thin flexible material may be used.

The hanger system 10 includes the pair of glasses 12 having a lens support frame 18 supporting a pair of lenses 20A, 20B, a pair of hinges 22A, 22B integral to the lens support frame 18, and a pair of temple arms 24A, 24B hinged to the lens support frame 18 with the pair of hinges 22A, 22B. The lens support frame 18 of the glasses 12 has a depth, designated as X and being a length from a front 26 of the lens support frame 18 to the hinges 22A, 22B, as noted in FIGS. 2, 4 and 5. The hanger system 10 further includes the carrier 14 for the glasses as well as the hanger 16. The hanger includes a main body 28 having top portion 30 for attachment to a display hook (not shown) and a lower portion 32 for securing the carrier 14 to the hanger 16. A support 34 is cantilevered from the main body 28 and has a first end 36 and a second end 38. The first end 36 is integral to the top portion 30 of the main body 28 and extends out from the main body 28 a distance of at least the depth X from the front 26 of the frame 18 to the hinges 22A, 22B. The second end 38 of the support 34 has a hinged tab 40 having an aperture 42 to receive one of the pair 22A of temple arms 22A, 22B. The glasses 12 are supported where front 26 of the frame 18 is oriented toward the main body 28 of the hanger 16 and the pair of temple arms 24A, 24B is oriented in a direction away from main body 28 when the temple arms 24A, 24B are in a folded condition. The hinged tab 40 provides for opening of the temple arms 24A, 24B relative to the frame 18 to allow a user to try on the glasses 12, while the glasses 12 remain attached to the hanger 16.

Figure 9:
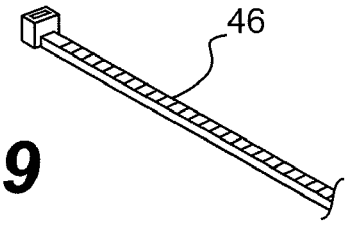
FIG. 9 is an isometric view of a fastener for use with the hanger system for glasses and case of FIG. 1.

In a preferred embodiment of the present invention, the lower portion 32 of the main body 28 for securing the carrier 14 to the hanger 16 is a web in the form of a pair of legs 44A, 44B for receiving the carrier 14. The legs 44A, 44B extend down from the top portion 30 of the hanger 16. The carrier 14, as shown, is a fabric pouch. The pouch can be made from any type of flexible material. However, rather than a simple pouch, the carrier 14 may also be any type of case or other container for holding glasses, as are presently known. The lower portion 32 of the hanger 16 may be modified, as required, to support different carrier types. Preferably, the support 34 is generally perpendicular to the main body 28 of the hanger 16. Preferably, the top portion 30 includes an aperture 42 to receive the display hook (not shown). The hinged tab 40 may be fastened to the temple arm 24A that extends through the aperture 42 with a fastener 46, such as a cable tie (see FIG. 9). The hinged tab 40 may be hinged to the support by, for example, a living hinge 48 formed in or molded into the hanger 16. Finally, the hanger system 10 may have a security tag 52 attached thereto.

Figure 4:
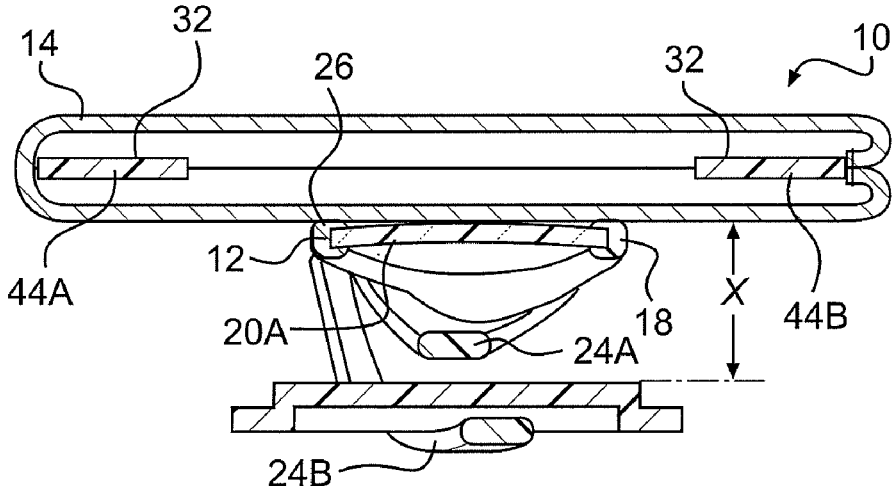
FIG. 4 is a cross-sectional view of the hanger system for glasses and case of FIG. 1, taken along lines 4-4 of FIG. 1.
Figure 5:
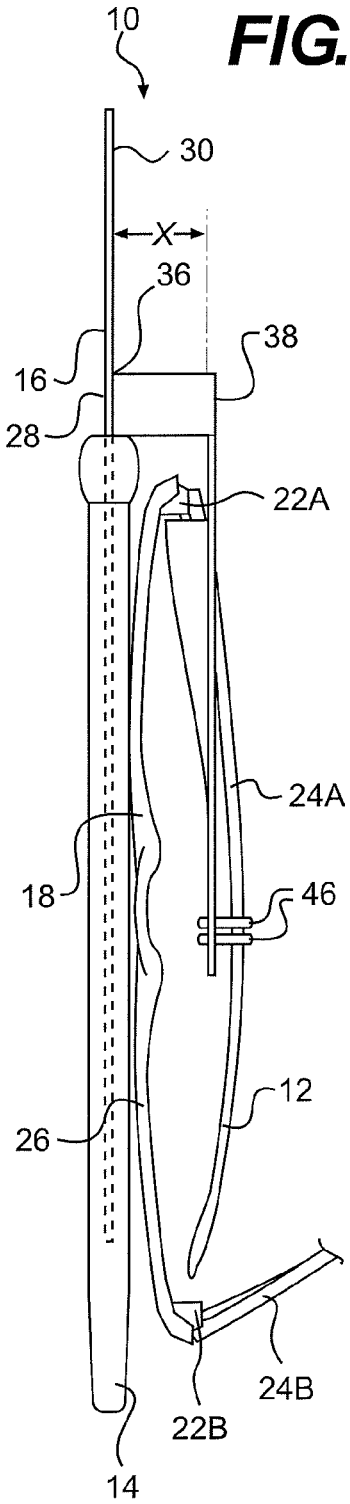
FIG. 5 is a side view of the hanger system for glasses and case of FIG. 1.
Figure 6:
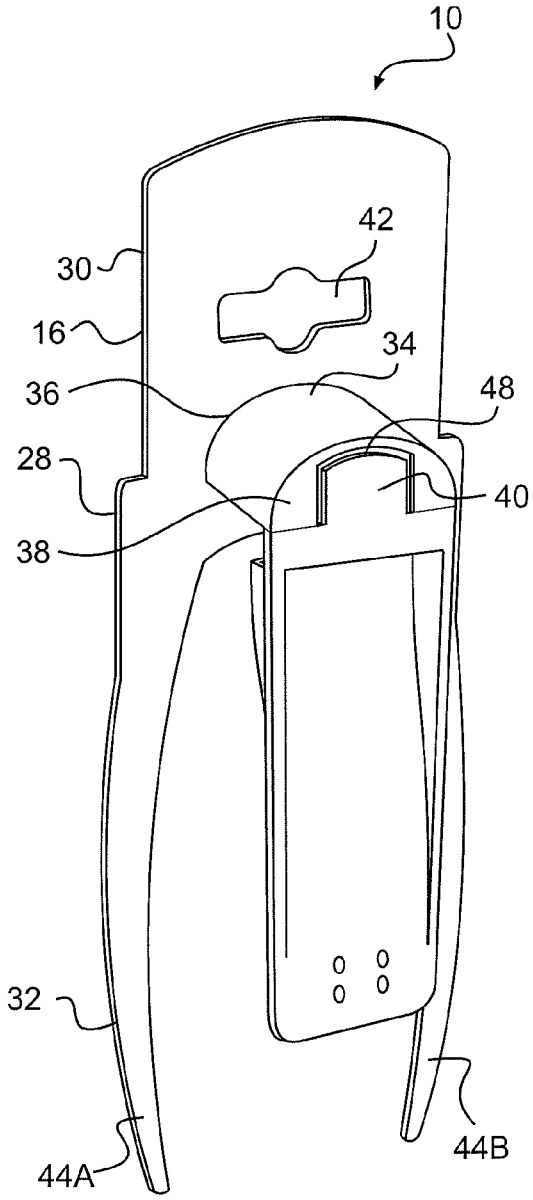
FIG. 6 is an isometric view of a hanger of the hanger system for glasses and case of FIG. 1.

As can best be seen in FIG. 4, the legs 44A, 44B, of the main body 28 of the hanger 16 are slid into the carrier 14. In this preferred embodiment, the carrier 14 is a soft cloth bag, constructed from a fabric and having a drawstring. However, it is within the desired scope of the present invention to use other types of cases and cases of different materials, for example, molded plastic, formed metal, flexible vinyl, and the like. As stated above, legs 42A, 42B of the main body 28 are located substantially inside the carrier 14.

Figure 7:
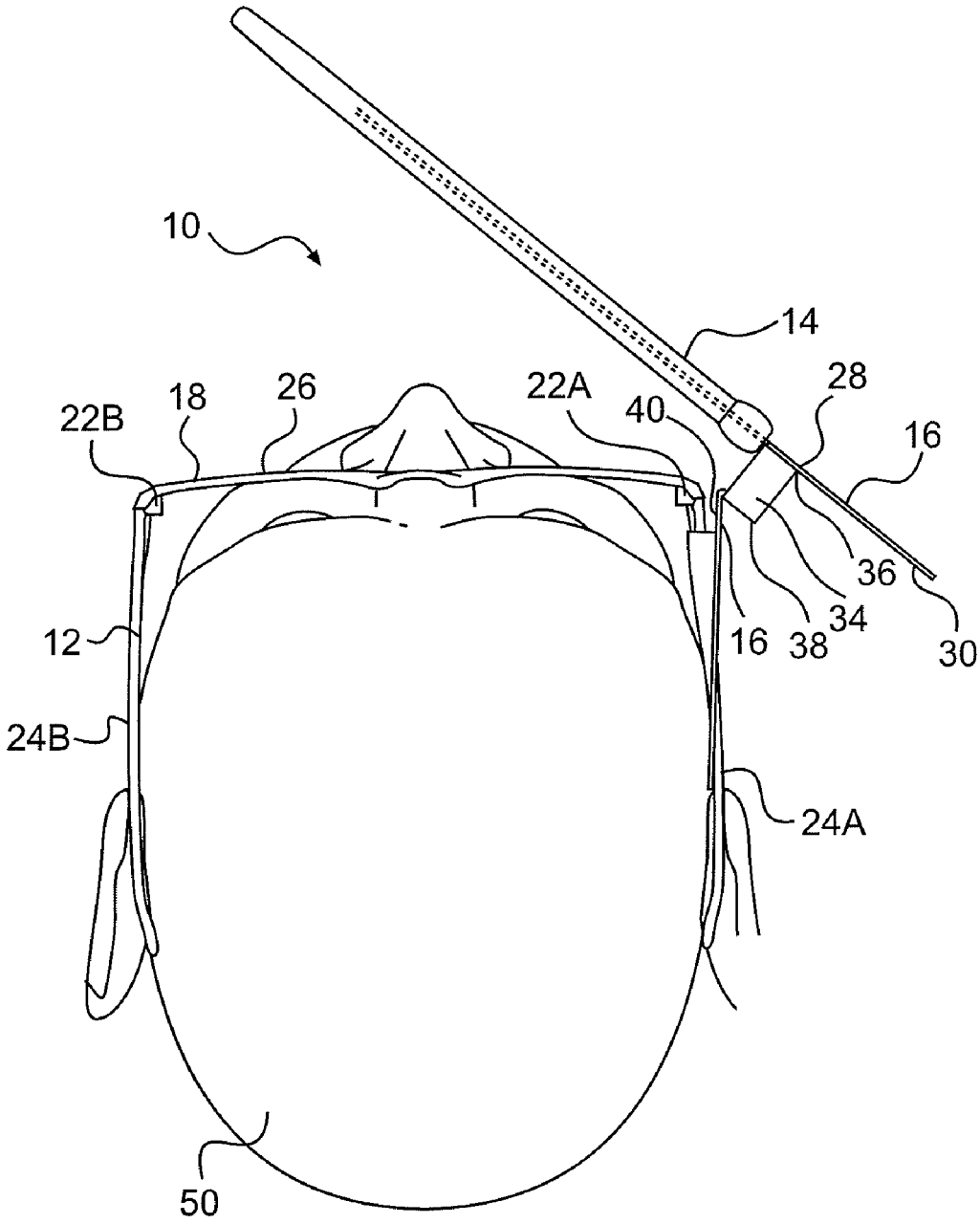
FIG. 7 is a top view of the hanger system for glasses and case of FIG. 1, shown as fitted on a the head of a user.
Figure 8:
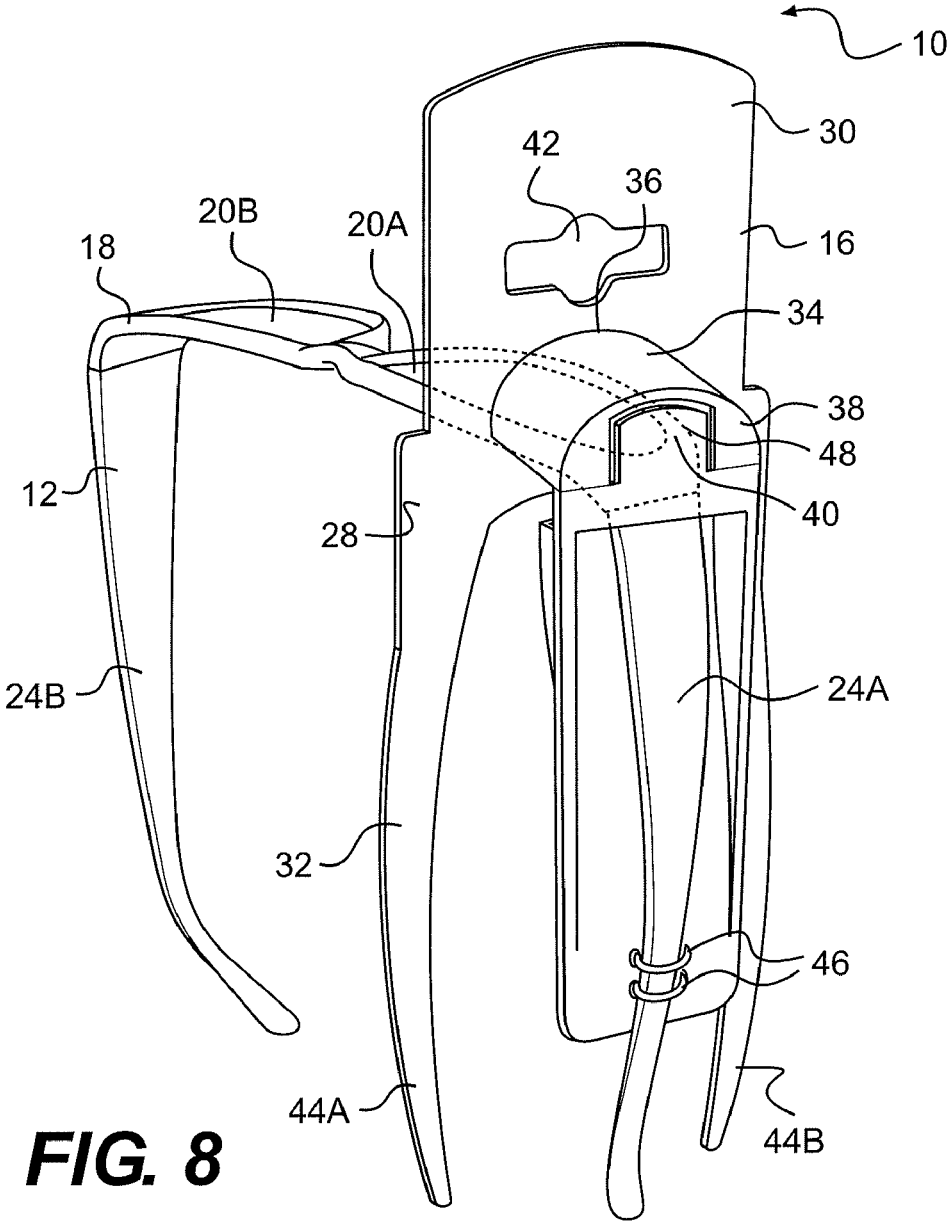
FIG. 8 is an isometric view of the hanger system for glasses and case of FIG. 1, shown without a carrier for clarity and shown with the temples of the glasses in an open position for placement on a potential customer.

In use, as best seen in FIG. 7, a user 50 walks up to a display in a store having numerous styles and powers of non-prescription glasses using the hanger system 10 of the present invention. The user 50 selects a desired power and style and removes the hanger system 10 from the rack. The hanger system 10 allows the user to open the temple arms 24A, 24B of the glasses 12 and try on the glasses 12 with the carrier 14 and hanger 16 remaining attached to the glasses 12.

The glasses 12 may be attached to the hinged tab 40 of the hanger 16 by any suitable means known in the art. In the preferred embodiment shown in the drawings, one of the temple arms 24A is first inserted through aperture 42 and then secured with fasteners 46, such as cable ties. See FIG. 9.

Preferably, the carrier 14 is held to the hanger 16 by a fastener such as a staple. However, other devices can be used to attach the carrier 14 to the hanger 16 (for example, even the drawstring 50 of the carrier would operate effectively.

The hanger system 10 "locks" the glasses 12 to the hanger 16. That is, the glasses 12 and hanger 16 remain as a single unit. This allows store personnel to easily monitor sales racks to determine whether customers have returned the hanger system 10 (including hanger 16 and glasses 12) to the display rack in a proper position (based on glasses strength). A customer typically would require the use of scissors or a knife to remove the glasses 12 from the hanger 16 by cutting fasteners 46. Therefore, the use of the fasteners 46 is a substantial deterrent to such a removal.

Additionally, since the fasteners 46 combined with the hanger 16 and case create a single, substantially inseparable unit (absent the use of scissors or a knife), an electronic security tag 52 (for example, an EAD or RFID tag) may be more effectively used where the security sticker 52 is attached to the hanger 16.

While the invention has been described in detail and with reference to specific embodiments thereof, it will be apparent to one skilled in the art that various changes and modifications can be made therein without departing from the spirit and scope thereof.

What is claimed is:

1. A hanger system for glasses and case, comprising:

(a) glasses having a lens support frame supporting a pair of lenses, a pair of hinges integral to the lens support frame, and a pair of temple arms hinged to the lens support frame with the pair of hinges, said frame of the glasses having a depth being from a front of the frame to the hinges;

(b) a carrier for the glasses;

(c) a hanger, comprising:

(i) a main body, comprising a top portion adapted for attachment to a display hook and a lower portion for securing the carrier to the hanger; and (ii) a support cantilevered from said main body, said support being generally perpendicular to the main body, said support having a first end and a second end, said first end integral to the top portion of the main body and extending out from said main body a distance of at least the depth from the front of the frame to the hinges, said second end of said support having a hinged tab, said hinged tab having an aperture therein to receive one of the pair of temple arms, wherein the glasses are supported where front of the frame is oriented toward the main body and the pair of temple arms is oriented in a direction away from main body, when the temple arms are in a folded condition;

whereby the hinged tab provides for opening of the temple arms relative to the frame to allow a user to try on the glasses, while the glasses remain attached to the hanger.

2. The hanger system of claim 1, wherein the top portion of the main body is constructed from a thin, flexible web.

3. The hanger system of claim 1, wherein the carrier is a pouch.

4. The hanger system of claim 3, wherein the pouch is constructed from a flexible material.

5. The hanger system of claim 1, wherein the top portion comprises an aperture to receive the display hook.

6. The hanger system of claim 1, wherein the hinged tab is fastened to the temple arm that extends through the aperture with a fastener.

7. The hanger system of claim 6, wherein the fastener is at least one cable tie.

8. The hanger system of claim 1, wherein the hinged tab is hinged to the second end of the support by a living hinge.

9. The hanger system and pair of glasses of claim 1, wherein the hanger system has a security tag attached thereto.

10. A hanger system for glasses and case, comprising:

(a) glasses having a lens support frame supporting a pair of lenses, a pair of hinges integral to the lens support frame, and a pair of temple arms hinged to the lens support frame with the pair of hinges, said frame of the glasses having a depth being from a front of the frame to the hinges;

(b) a carrier for the glasses;

(c) a hanger, comprising:

(i) a main body, comprising a top portion adapted for attachment to a display hook and a lower portion for securing the carrier to the hanger wherein the lower portion includes a web comprising a pair of legs extending down from the top portion, said legs for receiving the carrier; and (ii) a support cantilevered from said main body, said support having a first end and a second end, said first end integral to the top portion of the main body and extending out from said main body a distance of at least the depth from the front of the frame to the hinges, said second end of said support having a hinged tab, said hinged tab having an aperture therein to receive one of the pair of temple arms, wherein the glasses are supported where front of the frame is oriented toward the main body and the pair of temple arms is oriented in a direction away from main body, when the temple arms are in a folded condition;

whereby the hinged tab provides for opening of the temple arms relative to the frame to allow a user to try on the glasses, while the glasses remain attached to the hanger.

11. A hanger system for glasses and case, comprising:

(a) glasses having a lens support frame supporting a pair of lenses, a pair of hinges integral to the lens support frame, and a pair of temple arms hinged to the lens support frame with the pair of hinges;

(b) a carrier for the glasses;

(c) a hanger, comprising:

(i) a main body, comprising a top portion adapted for attachment to a display hook and a lower portion for securing the carrier to the hanger; and (ii) a support cantilevered from said main body, said support being generally perpendicular to the main body, said support to support the glasses where front of the frame is oriented toward the main body and the pair of temple arms is oriented in a direction away from main body, when the temple arms are in a folded condition;

whereby, when a user tries on the glasses, the glasses remain attached to the hanger.

* * * * *